US007236344B2

(12) United States Patent
McCullough

(10) Patent No.: US 7,236,344 B2
(45) Date of Patent: Jun. 26, 2007

(54) IONIC FLOW GENERATOR FOR THERMAL MANAGEMENT

(75) Inventor: Kevin A. McCullough, N. Kingstown, RI (US)

(73) Assignee: Cool Shield, Inc., Warwick, RI (US)

( * ) Notice: Subject to any disclaimer, the term of this patent is extended or adjusted under 35 U.S.C. 154(b) by 0 days.

(21) Appl. No.: 11/381,571

(22) Filed: May 4, 2006

(65) Prior Publication Data

US 2006/0250746 A1 Nov. 9, 2006

Related U.S. Application Data

(60) Provisional application No. 60/678,284, filed on May 6, 2005.

(51) Int. Cl.
*H01T 23/00* (2006.01)

(52) U.S. Cl. ..... 361/231; 361/226; 361/230; 361/233; 417/48

(58) Field of Classification Search ..... 361/230, 361/232, 233, 235, 226, 231; 95/78; 417/48, 417/49; 123/539; 250/423 F
See application file for complete search history.

(56) References Cited

U.S. PATENT DOCUMENTS

| | | | | |
|---|---|---|---|---|
| 3,022,430 | A | 2/1962 | Brown | |
| 3,054,553 | A | 9/1962 | White | |
| 3,056,587 | A | 10/1962 | Steigerwald | |
| 3,081,020 | A | 3/1963 | Rostas | |
| 3,151,259 | A | 9/1964 | Gloersen et al. | |
| 3,176,906 | A | 4/1965 | Redhead | |
| 3,176,907 | A | 4/1965 | Redhead | |
| 3,224,497 | A | 12/1965 | Blomgren, Sr. et al. | |
| 3,239,130 | A | 3/1966 | Naundorf, Jr. | |
| 3,240,421 | A | 3/1966 | Farnsworth | |
| 3,370,644 | A | 2/1968 | Daily et al. | |
| 3,374,941 | A | 3/1968 | Okress | |
| 3,554,669 | A | 1/1971 | Reader | |
| 3,601,503 | A | 8/1971 | Snouse | |
| 3,613,370 | A | 10/1971 | Paine | |
| 3,669,056 | A | 6/1972 | Wurmbrand et al. | |
| 3,751,715 | A * | 8/1973 | Edwards | 361/230 |
| 3,824,923 | A * | 7/1974 | Fisher et al. | 101/114 |

(Continued)

FOREIGN PATENT DOCUMENTS

| | | |
|---|---|---|
| JP | 5373655 | 6/1978 |

*Primary Examiner*—Brian Sircus
*Assistant Examiner*—Terrence Willoughby
(74) *Attorney, Agent, or Firm*—Barlow, Josephs & Holmes, Ltd.

(57) ABSTRACT

The apparatus for generating ionic flow of media includes a DC voltage supply having a positive terminal and a negative terminal with a collector connected to the negative terminal of the direct current voltage supply. The collector has a substantially tubular configuration with a rear and front section with inwardly tapering frusto-conical section therebetween. An emitter pin is connected to the positive terminal of the direct current voltage supply with the majority of the tip being located within the frusto-conical section of the collector. Alternatively, the front section of the collector may be made of a dielectric material, such as plastic. As a result, fluid flow, such as air flow, is generated from the input port of the rear section of the collector, through the frusto-conical section of the collector and out the output port of the front section of the collector.

19 Claims, 2 Drawing Sheets

U.S. PATENT DOCUMENTS 3,872,917 A 3/1975 Blomgren, Sr. et al.
4,227,894 A 10/1980 Proynoff
4,253,852 A 3/1981 Adams
4,339,782 A 7/1982 Yu et al.
4,449,159 A 5/1984 Schwab et al.
4,634,057 A 1/1987 Coffee et al.
4,924,937 A 5/1990 Beal et al.
5,006,761 A 4/1991 Torok et al.
5,121,286 A 6/1992 Collins
5,240,381 A 8/1993 Nagai et al.
5,326,227 A 7/1994 Nagai et al.
5,357,747 A 10/1994 Myers et al.
5,388,769 A 2/1995 Rodrigo et al.
5,480,286 A 1/1996 Nagai et al.
5,907,469 A * 5/1999 Kim et al. ..... 361/225
6,228,149 B1 5/2001 Alenichev et al.
6,926,758 B2 * 8/2005 Truce ..... 95/78

* cited by examiner

IONIC FLOW GENERATOR FOR THERMAL MANAGEMENT

CROSS REFERENCE TO RELATED APPLICATION

This application is related to and claims priority from earlier filed provisional patent application Ser. No. 60/678,284, filed May 6, 2005, incorporated herein by reference.

BACKGROUND OF THE INVENTION

The present invention generally relates to devices for use in generating air flow for thermal applications. Moreover, the present invention relates to using such devices to cool parts and components, such as those in a computer system, so those parts do not fail over time. The present invention relates to air flow generators that have no moving parts.

In the prior art, there are many ion media flow generating devices in the prior art. These prior art devices typically include an emitter pin and a surrounding collector body. The configuration of the collector casing is typically all metallic and in a tubular shape with the emitter pin located therein. See U.S. Pat. No. 3,151,259, issued to Gloersen, et al., for example. Gloersen shows a plasma accelerator system. Plasma may be defined as gas in an ionized state. In accordance with the Gloersen, there is provided a plasma accelerator 10 with a DC power supply 16 and a driving coil 13 that surrounds electrodes 11 and 12. The coil 13 is electrically insulated by sleeve 14. The coil 13 surrounds the cylindrical electrode 12 and is connected in series with the radial discharge gap and creates a magnetic field axially of the gap. One or more capacitors 18 are charged by the power supply 16. Current flow, indicated by J, is through conductor 21 along the inner electrode 11 across the radial gap to the cylindrical electrode 12 and, via flange 22, through the coil 13 and back through conductor 23. The shape of the electrodes 11 and 12 and the position of the coil 13 are such that the two forces will be operative in expelling the plasma from the discharge end of the accelerator into outer space or other evacuated region. The '259 patent discloses a system that is used in space craft for propulsion in zero or very low gravity. While the '259 patent does teach a plasma accelerator, its collector configuration is not well optimized for efficient production of gas for thermal management purposes or for being installed inline within a conduit.

Also, the collector in prior art devices have been found to be in a shape where the metallic body is first convergent then diverging. See, for example, U.S. Pat. No. 3,239,130, issued to Naundorf, Jr. which discloses a gas pumping ionic wind generator that uses a conical collector. This patent states that its convergent-divergent shape to help maintain a continuous arc. It appears that the shape of the collector, location of the emitter pin and other specific construction issues are the focus, as it is clear that the general concept of an ionic wind generator is well known in the art. See also, U.S. Pat. No. 4,339,782, issued to Yu et al. which discloses a collector region similar to that of Naundorf et al. See also, U.S. Pat. No. 4,449,159, issued to Schwab et al.

However, each of these prior art ion air flow generating devices include a collector shape and emitter pin location that is specific which will generate a given output of air flow. Further, none of the prior art references are specifically designed for air and liquid flow for thermal cooling environments and applications.

Therefore, there is a need for a ion air and liquid flow device with no moving parts that is well-suited for cooling parts in a thermally sensitive application, such as in a computer environment.

SUMMARY OF THE INVENTION

The present invention preserves the advantages of prior art thermal management and air flow devices. In addition, it provides new advantages not found in currently available devices and overcomes many disadvantages of such currently available devices.

The invention is generally directed to the novel and unique air generator using ionic flow. The apparatus for generating ionic flow of media includes a direct current voltage supply having a positive terminal and a negative terminal with a collector connected to the negative terminal of the direct current voltage supply. The collector has a substantially tubular configuration with a rear cylindrical section, which is connected to a middle inwardly tapering frusto-conical section, which is connected to a front cylindrical section having an output port. The front cylindrical section preferably has a smaller diameter than the rear cylindrical section. An emitter pin, with a preferably substantially conical tip, is connected to the positive terminal of the direct current voltage supply with the majority of the conical tip being located within the frusto-conical section of the collector. Alternatively, the rear section of the collector may be made of a dielectric material, such as plastic. As a result, fluid flow, such as air flow, is generated from the input port of the rear section of the collector, through the frusto-conical section of the collector and out the output port of the front section of the collector.

It is therefore an object of the present invention to provide an apparatus that is capable of generating air flow without fans and other mechanical components. It is another object of the invention to provide an apparatus that can generate ionic flow that is optimized for thermal management applications. It is yet another object of the present invention to create an apparatus for creating air and fluid flow with no moving parts and with reduced current and voltage. It is a further object of the present invention that provides an ion air and liquid flow device with no moving parts that is well-suited for cooling parts in a thermally sensitive application, such as in a computer environment.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

The present invention solves the problems in the prior art by providing a new and unique air or liquid (such as water) flow generator with no moving parts using ion generation methods.

The invention relates to the use of an ionizer for the purposes of air propulsion for cooling. Essentially, the apparatus of the present invention provides a passive fan that has no moving parts which, as a result, will greatly improve reliability over time.

Figure 2:
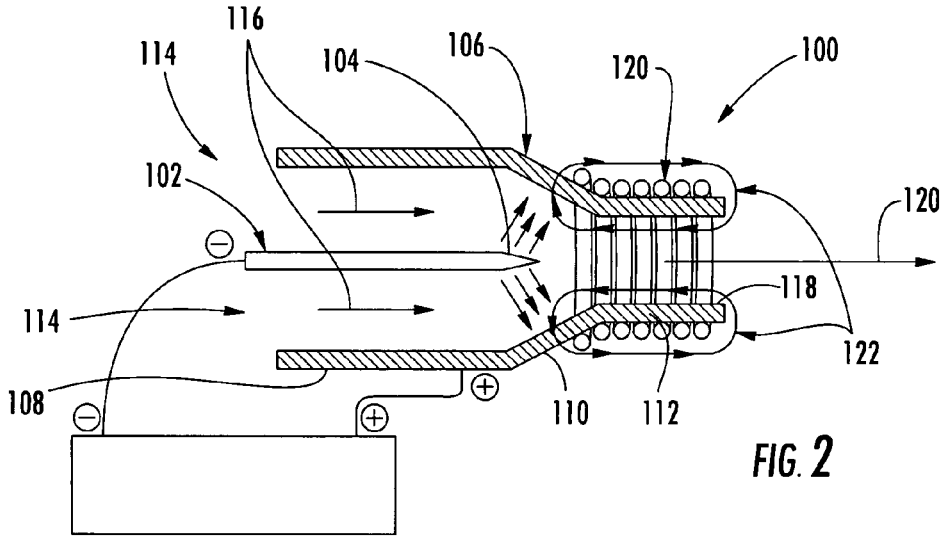
FIG. 2 is a cross-sectional view of an apparatus according to the apparatus of the present invention.

Referring first to FIG. 2 a cross-sectional view of a preferred embodiment of the ionic flow apparatus 100 of the present invention is shown in detail. An emitter pin 102, with a beveled tip surface 104, is positioned within the collector, which is generally referred to as 106. The collector is made of an electrically conductive material, such as brass, metallized dielectric material, or material with electrically conductive paint thereon.

Figure 1:
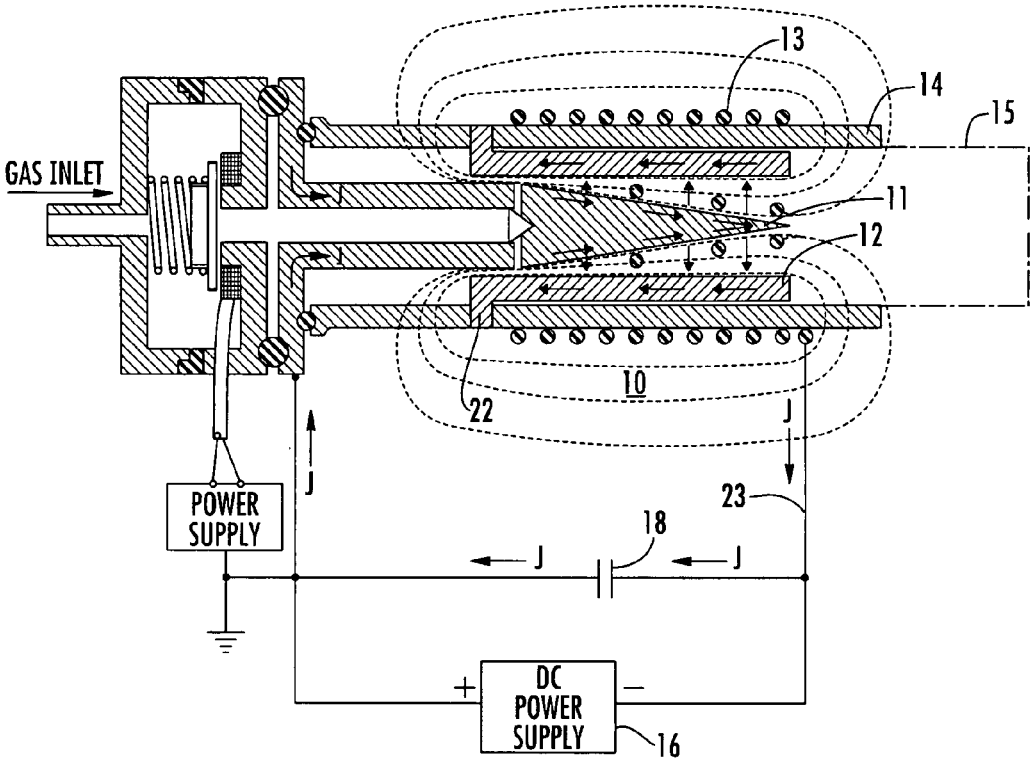
FIG. 1 (PRIOR ART)
FIG. 1 is a cross-sectional view of a prior art apparatus for ionically pumping air.

The collector 106 uniquely includes three distinct sections, namely a rear cylindrical section 108, a middle frusto-conical section 110 and a front section 112. As can be seen in FIG. 1, sections 108, 110 and 112 are tubular and connected to one another to form one large tubular collector 106 that has a large cylindrical section 108 that tapers inwardly at frusto-conical section 110 to terminate at front section 112. As a result, a nozzle-like configuration is provided.

In the preferred embodiment of FIG. 2 the entire collector 106, including its sections 108, 110 and 112, are made of metal, such as brass, or a metallic coated or plated dielectric material, such plastic. In general, the entire collector 106 is provided to be electrically conductive.

DC volts in the range of −7,500 to −10,000 is delivered to the emitter pin at very low amperage. The collector 106 is connected to the positive terminal of the DC voltage source. The introduction of such a voltage causes negatively charged particles 114 from ambient air to be drawn to the collector 106 which then starts a chain reaction of flow of such particles at lines 116.

The apparatus 100 of the invention harnesses this general ionic wind concept by using a collector 106, i.e. nozzle, having a frusto-conical section 110 to concentrate and direct the negatively charged air particles 114 out through the exit aperture 118 to provide a flow of media at 120. A rear section 108 and front section 112 are positioned on either side of the frusto-conical section 110. The tip 104 of the emitter pin 102 preferably resides in the frusto-conical section 110 and more preferably closer to front section 112 rather than rear section 108. However, this positioning can be altered depending on the application at hand. For example, it has been found that the higher the voltage, the further back toward rear section 108, the emitter pin 102 should be located for optimal performance. As a result, air at 114 is pulled from behind the collector 106 and blown out through the front at 120 to act as an ionic wind or media fan.

In addition, a magnetic field coil 120 may optionally be placed about the collector 106 tube to further accelerate the negatively charged particles to produce a stronger blowing effect. It is well known in the art that running current through a wound coil of electrically conductive material, produces a magnetic field 122, as shown in FIG. 2. The use of a coil 120 to generate a magnetic field 122 is so well known in the art that further details of the operation thereof not be discussed in detail herein.

While the general concept of using a collector 106 and an emitter pin 102 to create an ionic generation of wind is generally shown in the prior art, each of the prior art structures differ from the present invention in that their collector/emitter constructions because they are specifically designed for a particular purpose unlike applicants thermal management purposes.

Figure 3:
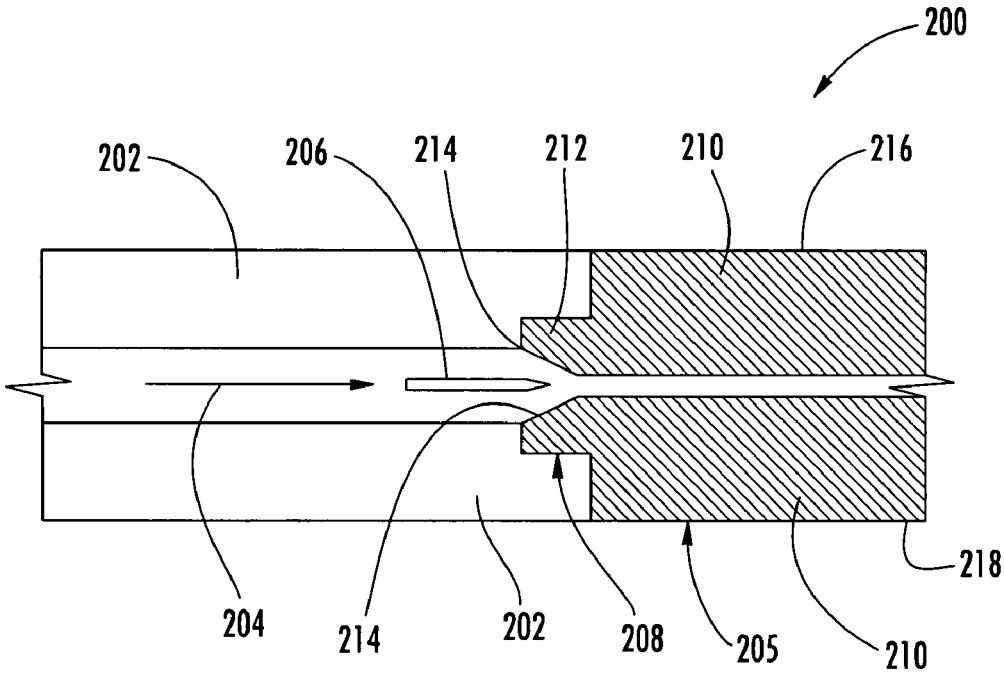
FIG. 3 is a cross-sectional view of an apparatus according to an alternative embodiment of the present invention.

Turning now to FIG. 3, an alternative embodiment 200 of the ionic flow generator of the present invention is shown in detail, FIG. 3 shows a specific construction of an inline version of the ionic wind generating apparatus 200 used as an inline pump for pumping either air or liquid, such as water. In FIG. 3, the sizing of the components are exaggerated for ease of illustration and discussion.

The apparatus 200 includes a collector generally referred to as 205 which includes rear section 202 which is made preferably of a dielectric material. Rear section 202 is preferably made of a dielectric material for the purposes of directing air flow 204 but to not divert ion flow in a perpendicular direction from the emitter pin 206. The combination of physical air flow direction and ionic flow direction in the same collector configuration 205 is new, novel and unique in the art.

A middle frusto-conical section 208 is preferably integrated with a front section 210. Sections 208 and 210 are preferably electrically conductive and electrically connected to ground. The conductive portion 208, 210 and the dielectric portion 202 preferably interlock with one another at seat 212 so that a smooth junction 214 is created to avoid turbulence in the air flow 204. Also, the outer sides 216 and 218 of the apparatus are configured to be substantially parallel to one another. For example, the outer configuration 216, 218 can be itself cylindrical so that it can be easily installed inline within a conduit for enhancing flow of media therethrough. The construction of FIG. 3 is one of many different constructions for this purpose.

The conductive material for sections 208 and 210 may be made of metal, such as brass, or plated with nickel, electroless nickel, conductive paint (e.g. filled with silver) or plated dielectric material where the dielectric material can be plastic. The dielectric section 202 is preferably plastic but could be other dielectric materials. Alternatively, the entire apparatus 200 may be a unitary body where only a portion, namely sections 208 and 210 are plated.

The ionic flow generator 100, 200 is particularly well-suited for use in thermal management. For example, the flow pump 100, 200 of the type in FIG. 3 can be positioned inline within a liquid hose, within a computer, to pump cooling liquid to various component parts. The apparatus 100, 200 of the present invention can be used within a heat sink assembly (not shown) to induce flow of air or liquid within parts (e.g. hollowed fins) to enhance heat dissipation.

Therefore, the present invention provides a new and useful ion flow pump apparatus that can be used for thermal management. The structure of and materials used in the collector body 106, 205 and the positioning of the emitter pin is optimized for superior performance.

It would be appreciated by those skilled in the art that various changes and modifications can be made to the illustrated embodiments without departing from the spirit of the present invention. All such modifications and changes are intended to be covered by the appended claims.

What is claimed is:

1. An apparatus for generating ionic flow of media, comprising:

a direct current voltage supply having a positive terminal and a negative terminal;

a collector connected to the negative terminal of the direct current voltage supply; the collector having a substantially tubular configuration with a rear cylindrical section, having an input port, which is connected to a middle inwardly tapering frusto-conical section which is connected to a front cylindrical section having an output port; the front cylindrical section having a smaller diameter than the rear cylindrical section;

an emitter pin, having a main body and a substantially conical tip, being connected to the positive terminal of the direct current voltage supply; the majority of the conical tip being located within the frusto-conical section of the collector; and whereby fluid flow is generated from the input port of the rear section of the collector, through the frusto-conical section of the collector and out the output port of the front section of the collector.

2. The apparatus of claim 1, wherein direct current voltage supply provides voltage in the range of −7,500 to −10,000 volts.

3. The apparatus of claim 1, wherein the media is gas.

4. The apparatus of claim 1, wherein the media is air.

5. The apparatus of claim 1, wherein the media is liquid.

6. The apparatus of claim 1, wherein the rear cylindrical section, the middle inwardly tapering frusto-conical section and front cylindrical section are made of metal.

7. The apparatus of claim 1, wherein the rear cylindrical section, the middle inwardly tapering frusto-conical section and front cylindrical section are made of dielectric material plated with metal.

8. The apparatus of claim 1, wherein the rear cylindrical section, the middle inwardly tapering frusto-conical section and front cylindrical section are made of plastic coated with electrically conductive paint.

9. The apparatus of claim 1, wherein the rear cylindrical section, the middle inwardly tapering frusto-conical section and front cylindrical section are made of brass.

10. An apparatus for generating ionic flow of media, comprising:

a direct current voltage supply having a positive terminal and a negative terminal;

a collector connected to the negative terminal of the direct current voltage supply; the collector having a substantially tubular configuration with a rear cylindrical section, having an input port, and being made of a dielectric material; the rear cylindrical section being connected to a middle inwardly tapering frusto-conical section which is connected to a front cylindrical section having an output port; the front cylindrical section having a smaller diameter than the rear cylindrical section; the middle inwardly tapering frusto-conical section and the front section being made of an electrically conductive material;

an emitter pin, having a main body and a substantially conical tip, being connected to the positive terminal of the direct current voltage supply; the majority of the conical tip being located within the middle frusto-conical section of the collector; and whereby fluid flow is generated from the input port of the rear section of the collector, through the frusto-conical section of the collector and out the output port of the front section of the collector.

11. The apparatus of claim 10, wherein direct current voltage supply provides voltage in the range of −7,500 to −10,000 volts.

12. The apparatus of claim 10, wherein the media is gas.

13. The apparatus of claim 10, wherein the media is air.

14. The apparatus of claim 10, wherein the media is liquid.

15. The apparatus of claim 10, wherein the middle inwardly tapering frusto-conical section and front cylindrical section are made of metal.

16. The apparatus of claim 10, wherein the middle inwardly tapering frusto-conical section and front cylindrical section are made of dielectric material plated with metal.

17. The apparatus of claim 10, wherein the middle inwardly tapering frusto-conical section and front cylindrical section are made of plastic coated with electrically conductive paint.

18. The apparatus of claim 10, wherein the middle inwardly tapering frusto-conical section and front cylindrical section are made of brass.

19. The apparatus of claim 10, wherein the dielectric material is plastic.

* * * * *